US005446930A

United States Patent [19]

Clark

[11] Patent Number: 5,446,930

[45] Date of Patent: Sep. 5, 1995

[54] PORTABLE SHOWER ENCLOSURE

[76] Inventor: Gregory M. Clark, 167 North Avenue, Westport, Conn. 06880

[21] Appl. No.: 79,769

[22] Filed: Jun. 22, 1993

[51] Int. Cl.[6] ..... A47K 3/23

[52] U.S. Cl. ..... 4/599; 4/601; 135/137

[58] Field of Search ..... 4/601, 602, 603, 599, 4/900; 135/906, 104, 106

[56] References Cited

U.S. PATENT DOCUMENTS

| | | | |
|---|---|---|---|
| 743,623 | 11/1903 | Dinneen | 4/601 |
| 2,938,524 | 5/1960 | Benson | 135/104 |
| 3,039,478 | 6/1962 | Timmons | 135/906 X |
| 3,606,618 | 9/1971 | Veech | 4/603 |
| 3,681,788 | 8/1972 | Le Blanc et al. | 4/602 |
| 3,800,814 | 4/1974 | Hibbert | 135/906 X |
| 3,837,405 | 9/1974 | Huddle | 135/906 X |

FOREIGN PATENT DOCUMENTS

| | | | |
|---|---|---|---|
| 2513871 | 4/1983 | France | 4/601 |
| 0715301 | 9/1954 | United Kingdom | 4/602 |

*Primary Examiner*—Robert M. Fetsuga
*Attorney, Agent, or Firm*—Haynes N. Johnson

[57] ABSTRACT

A portable shower is formed of a base and upper shower ring carrying spray nozzles. The base and the ring each have sockets directed slightly outwardly from the vertical. Straight plastic pipes are fitted into the sockets to join the base and the shower ring, and, since the pipes have to be flexed in order to fit within the sockets, the pipes provide a tensioned fit which holds the unit together. At least one of the pipes carries a water inlet so that it can be connected to a hose and, so, carry water to the ring. Two hoses can be used, if desired, one for hot water and the other for cold; and then two of the pipes will carry water to the ring. In such event, a mixing chamber is provided in the ring so water of uniform temperature comes from each of the spray outlets in the shower ring. The base is a tank which holds water to provide weight and, so, stability to the shower.

16 Claims, 2 Drawing Sheets

Fig.1.
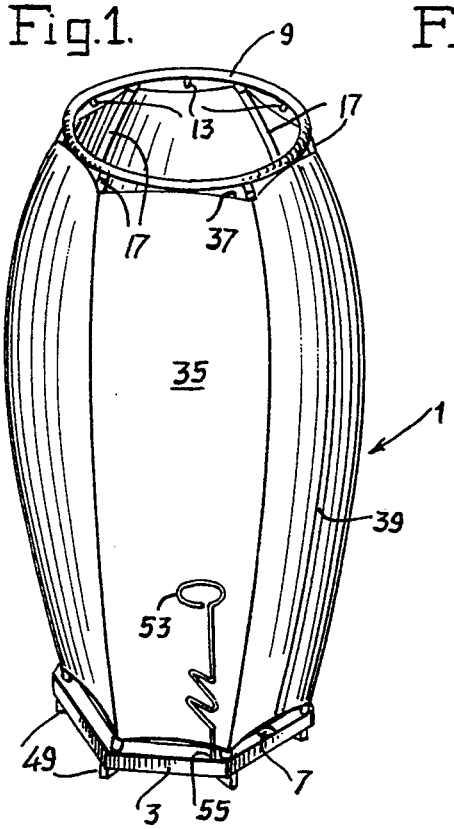
Fig.2.
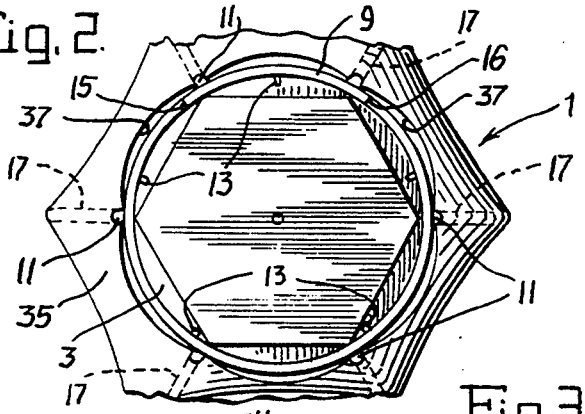
Fig.3.
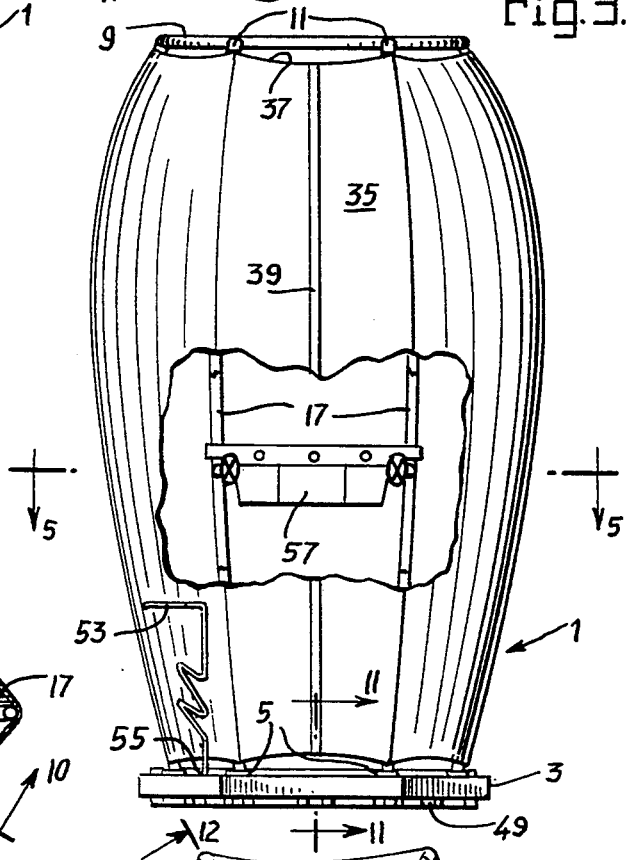
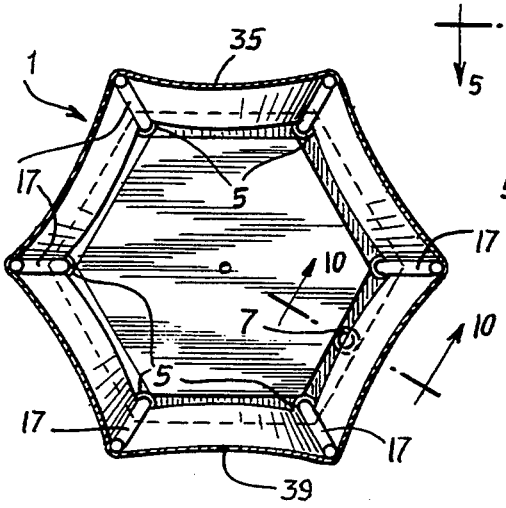
Fig.5.
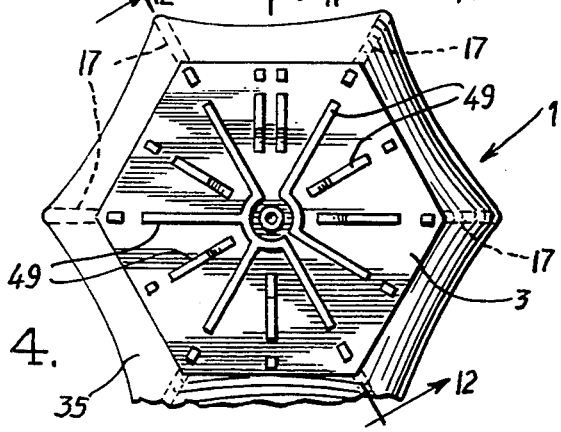
Fig. 4.

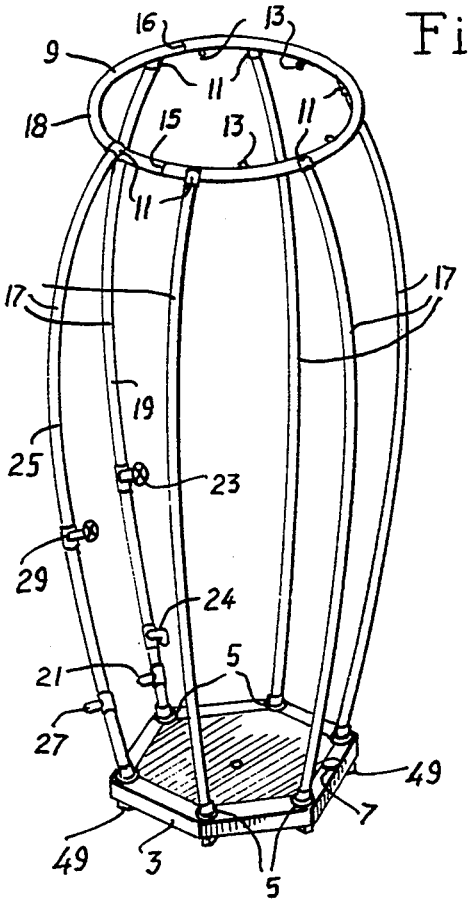
Fig.7.
Fig.6.
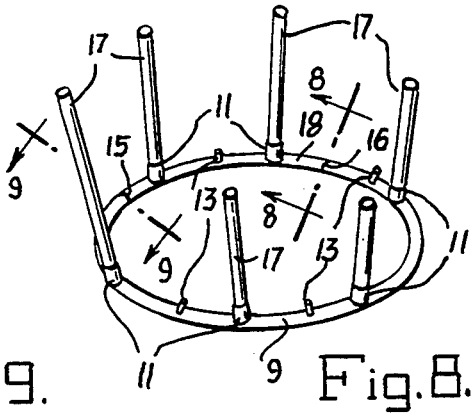
Fig.9.
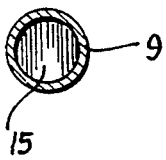
Fig.8.
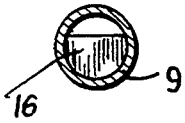
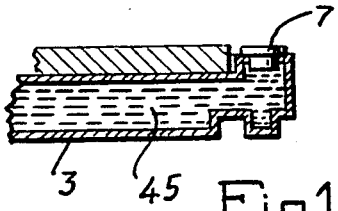
Fig.10.
Fig.11.
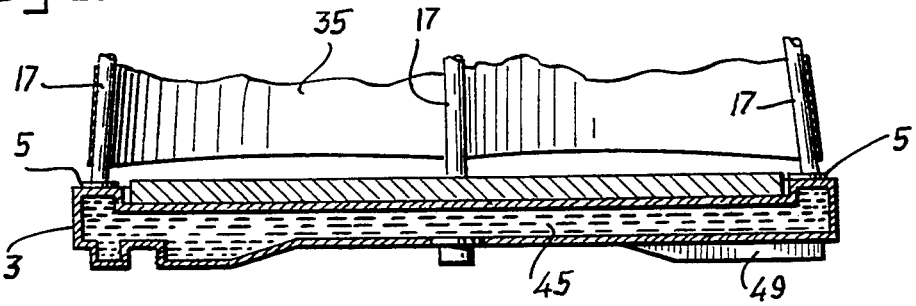
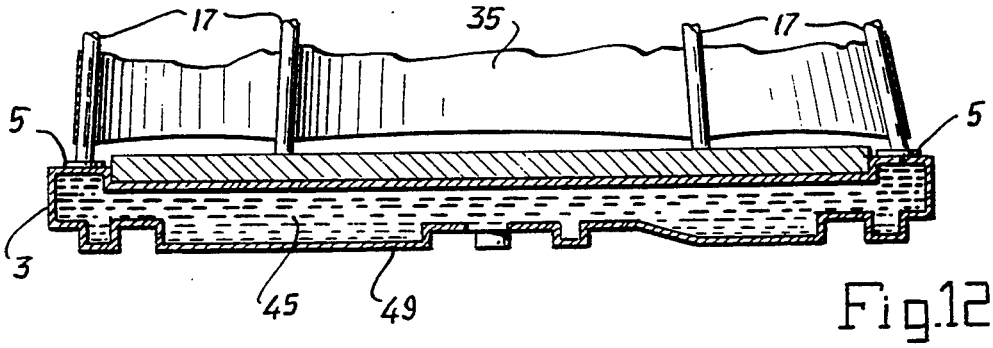
Fig.12.

PORTABLE SHOWER ENCLOSURE

FIELD OF THE INVENTION

This invention relates to the field of showers which are portable and readily assembled and disassembled, but which is free-standing and self-supporting.

BRIEF SUMMARY OF THE INVENTION

My portable shower is of a type which is used outdoors. It is formed of a base and upper shower ring carrying one or more spray nozzles. The base and the ring each have a series of complementary sockets facing one another and directed slightly outwardly from the vertical. Straight plastic pipes are fitted into the sockets to join the base and the shower ring; but, since the pipes have to be flexed slightly in order to fit within the angled sockets, the pipes provide a tensioned fit which holds the unit together. The unit can be assembled without tools, using only hand pressure.

One or two of the pipes are used to carry water to the shower ring, in addition to being used for support. These water-carrying pipes have a water inlet so that they can be connected to a hose and, thus, carry water to the ring. Two hoses can be used, if desired, one for hot water and the other for cold; and then two of the pipes will carry water to the ring. In such event, a mixing chamber is provided inside the shower ring so water of uniform temperature comes from each of the spray outlets in the shower ring.

A shower curtain fits about the upper ends of the pipes, just below the shower ring. It is dimensioned for a snap fit.

The base is a generally flat, horizontal tank holding about pounds of water. It provides stability for the unit, functions as a foundation, and enables the use of a tensioned structure.

DESCRIPTION OF THE DRAWINGS

FIG. 1 is a perspective view of my shower.

FIG. 2 is a top plan view

FIG. 3 is a side elevation.

FIG. 4 is a bottom plan view.

FIG. 5 is a section taken on line 5—5 of FIG. 3.

FIG. 6 is a perspective view showing the assembly of the shower ring and the pipes. The unit is shown upside down.

FIG. 7 is a perspective of the assembled shower with the curtain removed.

FIG. 8 is a section taken on line 8—8 of FIG. 6.

FIG. 9 is a section taken on line 9—9 of FIG. 6.

FIG. 10 is a section taken on line 10—10 of FIG. 5.

FIG. 11 is a section taken on line 11—11 of FIG. 3.

FIG. 12 is a section taken on line 12—12 of FIG. 4.

DETAILED DESCRIPTION OF THE INVENTION

My shower 1 is made of three principal elements, a base 3, a shower ring 9, and supporting struts or pipes 17.

The base is shaped like a hexagon and has a pipe-receiving socket 5 in each corner, proximate to its perimeter. These sockets face upwardly and are essentially vertical, but slant slightly outwardly away from the center of the base. This angle from the vertical is between about five and fifteen degrees.

The shower ring 9 is circular and has six pipe-receiving sockets 11. These sockets face downwardly and are essentially vertical, but slant slightly outwardly away from the center of the ring. This slanting is at an angle of between about five and fifteen degrees. The ring sockets 11 are located in positions complementary to the positions of the base sockets 5. At least one of the sockets interconnects with the inside of the ring so that water can be carried into the ring. Preferably two of the sockets interconnect, so that both hot and cold water can be carried to the ring. In such event, one socket receives cold water from pipe 19, and the other receives hot water from pipe 25. The ring carries several downwardly pointed nozzles 13 to produce a shower spray.

The number and relative positions of the lower sockets 5 and the upper sockets 11 correspond. Six pipes or struts 17 of equal length run between the base sockets 5 and the shower ring sockets 11 (These six include water pipes 19 and 25). The pipes are made of PVC and are initially straight. Since the sockets are angled slightly outwardly from the vertical, this means that the pipes have to be bent slightly in order to be fitted within both the upper and lower sockets 5 and 11. The result is that, once in the sockets, the pipes exert an outward force on the sockets, creating tension in the assembled unit, which gives it structural stability and keeps it from coming apart. This use of tension for assembly results in the unit being both free-standing and portable.

Preferably, the shower ring is made of aluminum and the base is made of rotationally molded polyethylene.

Cold water pipe 19 has a hose fitting 21 for receiving cold water from, say, a garden hose, and a control valve 23 above the fitting. It can also have a foot faucet 24 lower down, used for washing one's feet. Hot water pipe 25 has a hose fitting 27 for receiving hot water from a second hose, and a control valve 29 above the fitting.

Cold and hot water pipes 19 and 25 enter shower ring 9 between a pair of nozzles 13. Between one of these pipes and its adjacent nozzle 13 is a closed baffle 15 preventing water flow in the shower ring 9 in that direction. Between the other of these pipes and its adjacent nozzle 13 is a half baffle 16, half closing the shower ring. Thus, a mixing chamber 18 is formed in the shower ring between these two baffles, which mixes the incoming hot and cold water to a uniform temperature before it gets to the nozzles.

A shower curtain 35 fits over the struts 17. It has a circular opening 37 at the top and an-entrance slit 39 down the side. Opening 37 is of such a size that it can be stretch fitted over shower ring 9 and rest on the outside of struts 17 at their top. Thus, it will hold itself in place. Velcro fasteners can be used on the two sides of the slit to act as a curtain closure.

In order to give the assembled shower stability, base 3 is hollow, formed as a generally flat, horizontal tank 45 which can hold about 100 pounds of water. Tank 45 can be filled and emptied through fill cap 7. Additionally, the bottom of the base 3 has treads 49; these prevent the base from being pushed sidewise. They also allow for air circulation and drainage.

A towel bar 53 can be located outside the shower curtain 35, fitting within a socket 55 in the base. Also, a shower caddy 57 for holding soap and shampoo can be fitted across valves 23 and 25 inside the shower.

To assemble my shower 1, one places the shower ring on the ground, upside down, with its sockets 11 facing upwards (FIG. 6). Hot and cold water pipes 19 and 25 are inserted into a pair of adjacent sockets. These should be the sockets between baffles 15 and 16. This unit is then turned upright and the other ends of pipes 19 and 25 inserted into a pair of adjacent sockets 5 in base 3. This will take a slight amount of force since the pipes have to be bent slightly to be fitted into the sockets. The remaining four pipes 17 are then bent slightly and inserted into their corresponding upper and lower sockets. As a result of the bending of the pipes, the ends of the pipes will press outwardly against the sockets and the structure will be under tension, giving it structural stability.

The base 3 is now filled with water through fill cap 7; the shower curtain 35 is installed by pulling its opening 37 over shower ring 9; and towel bar 53 and shower caddy 57 are installed. Appropriate hoses are then attached to hose fittings 21 and 27. The shower 1 is then ready for use.

Shower 1 can easily be disassembled by reversing this procedure.

Though I prefer to have both top and bottom sockets 5 and 11 angled somewhat from the vertical, it will be appreciated that, if the relative dimensions of the base 3 and shower ring 9 are adjusted, one set of sockets can be vertical and the other angled, and tension will still result. For example, if the diameter of the base is greater than that of the ring, the sockets 5 in the base could be vertical and only the sockets 11 in the shower ring need be at an angle.

I claim:

1. A self-supporting portable shower including a base, a shower ring, and supporting pipes, said base including a plurality of lower pipe-receiving sockets, said sockets facing upwardly and being angled outwardly from the vertical, said shower ring being positioned above said base and including at least one nozzle and a plurality of upper pipe-receiving sockets facing downwardly, said upper pipe-receiving sockets corresponding in number and relative position to said lower pipe-receiving sockets and being angled outwardly from the vertical, said supporting pipes being dimensioned to fit, and fitting, with one end thereof in a said upper pipe-receiving socket and the other end in a said lower pipe-receiving socket, and said upper pipe-receiving sockets and said lower pipe-receiving sockets being angled outwardly at such an angle as to result in tension between said supporting pipes and their respective upper and lower pipe-receiving sockets, whereby said shower ring is held in place.

2. A self-supporting portable shower as set forth in claim 1 in which said upper pipe-receiving sockets and said lower pipe-receiving sockets are angled outwardly at an angle from about five to about fifteen degrees.

3. A self-supporting portable shower as set forth in claim 1 in which said base defines a tank to receive water.

4. A self-supporting portable shower as set forth in claim 3 in which said base has a lower surface and includes gripping treads on said lower surface.

5. A self-supporting portable shower as set forth in claim 3 in which said base is made of rotationally molded polyethylene.

6. A self-supporting portable shower as set forth in claim 1 in which at least one of said pipes is interconnected with said shower ring through its respective upper pipe receiving socket, said last-named pipe having a fitting to receive water from an external source.

7. A self-supporting portable shower as set forth in claim 1 with two of said pipes being interconnected with said shower ring through their respective upper pipe-receiving sockets, each of said last-named pipes having a fitting to receive water and a valve to control water flow to said shower ring.

8. A self-supporting portable shower as set forth in claim 7 in which said shower ring includes baffles to form a mixing chamber, said mixing chamber interconnecting with said last-named upper pipe-receiving sockets.

9. A self-supporting portable shower as set forth in claim 1 including a shower curtain to fit about said pipes, said shower curtain having an upper opening dimensioned to fit over said shower ring and rest upon the upper portions of said pipes.

10. A kit for use in assembling a self-supporting shower, said kit including a base, a shower ring, and a plurality of straight pipes, said base including a plurality of lower pipe-receiving; sockets along its upper periphery, said sockets facing upwardly and being angled outwardly from the vertical when said base is resting on the ground, said shower ring being positionable above said base and including at least one nozzle and a plurality of upper pipe-receiving sockets, said upper pipe-receiving sockets being angled outwardly and corresponding in number and relative position to said lower pipe-receiving sockets, pipes dimensioned to fit with each one with one end in a said upper pipe-receiving socket and the other end in a said lower pipe-receiving socket, whereby said pipes can be held in position between said upper pipe-receiving sockets an said lower pipe receiving sockets by means of tension between said pipes and said upper and lower pipe-receiving sockets, and one of said pipes being interconnectable with said shower ring through its respective upper pipe-receiving socket and having a fitting to receive water.

11. A portable self-supporting shower including a shower ring and supporting pipes, first means associated with said shower ring for holding said supporting pipes, said means holding said supporting pipes at an angle outwardly from the vertical, a base below said shower ring, said base including a plurality of surfaces defining a tank having a lower base portion and an upper flat portion for users to stand on, means for filling said tank with water, and second means mounted on said upper flat portion for receiving shower-supporting pipes and holding them at an angle outwardly from the vertical, whereby said supporting pipes will be held in tension between said first and second means, whereby said shower will be self-supporting and said base, when filled with water, will provide a stable foundation for a portable shower, and, when, emptied, can be readily transported.

12. A portable self-supporting shower enclosure including supporting pipes, upper and lower counterpart fixtures for said supporting pipes, said upper counterpart fixture being positioned above said lower counterpart fixture, said upper and lower counterpart pipe fixtures having complementary first and second means, respectively, for holding said supporting pipes, said first means extending downwardly for holding said supporting pipes, said first means holding said supporting pipes at an angle extending outwardly from the vertical, said second means extending upwardly for holding said supporting pipes, said second means holding said supporting pipes at an angle extending outwardly from the vertical, whereby said first and said second holding means provide angular tension on said supporting pipes to hold said supporting pipes in position relative to said upper and lower counterpart fixtures, said upper fixture being a shower ring, and said lower fixture being a supporting base.

13. A self-supporting portable shower enclosure as set forth in claim 12 in which said base defines a tank to hold water.

14. A self-supporting portable shower enclosure as set forth in claim 12 in which at least one of said supporting pipes is interconnected with said upper fixture, said last-named pipe having a fitting to receive water from an external source.

15. A self-supporting portable shower enclosure as set forth in claim 12 with two of said supporting pipes being interconnected with said shower ring through their respective first means, each of said last-named supporting pipes having a fitting to receive water and a valve to control water flow to said shower ring.

16. A self-supporting portable shower as set forth in claim 15 in which said shower ring includes baffles to form a mixing chamber, said mixing chamber interconnecting with said last-named first means.

* * * * *